US010400549B2

(12) United States Patent
Dykstra et al.

(10) Patent No.: US 10,400,549 B2
(45) Date of Patent: Sep. 3, 2019

(54) MUD SAG MONITORING AND CONTROL

(71) Applicant: Halliburton Energy Services, Inc., Houston, TX (US)

(72) Inventors: Jason D. Dykstra, Spring, TX (US); Qiuying Gu, Humble, TX (US); Yuzhen Xue, Humble, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 211 days.

(21) Appl. No.: 15/323,830

(22) PCT Filed: Jul. 13, 2016

(86) PCT No.: PCT/US2016/042008

§ 371 (c)(1),
(2) Date: Jan. 4, 2017

(87) PCT Pub. No.: WO2017/011510

PCT Pub. Date: Jan. 19, 2017

(65) Prior Publication Data

US 2017/0198553 A1 Jul. 13, 2017

Related U.S. Application Data

(60) Provisional application No. 62/191,932, filed on Jul. 13, 2015.

(51) Int. Cl.
*E21B 21/08* (2006.01)
*E21B 44/00* (2006.01)
(Continued)

(52) U.S. Cl.
CPC ..... *E21B 41/0092* (2013.01); *E21B 21/00* (2013.01); *E21B 21/08* (2013.01);
(Continued)

(58) Field of Classification Search
CPC ..... E21B 41/0092; E21B 21/08; E21B 47/10; E21B 44/00; E21B 21/00; E21B 21/01; E21B 21/062; G06N 5/047
See application file for complete search history.

(56) References Cited

U.S. PATENT DOCUMENTS 6,176,323 B1 1/2001 Weirich et al.
7,003,439 B2 * 2/2006 Aldred ..... E21B 44/00 175/45

(Continued)

FOREIGN PATENT DOCUMENTS

WO 2004059123 A1 7/2004
WO 2015057222 A1 4/2015

OTHER PUBLICATIONS

William C. Lyons, Working Guide to Drilling Equipment and Operations, Elsevier:2010, Chapter 6, p. 322 (Year: 2010).*

(Continued)

*Primary Examiner* — Jay Hann
(74) *Attorney, Agent, or Firm* — Gilliam IP PLLC

(57) ABSTRACT

A mud sag monitoring system may be configured for real-time evaluation of sagging potential of a circulating mud. The monitoring system may include both physics-based sagging prediction models and data-driven sagging detection classifiers that allow for predicting the sagging potential. The sagging potential may also be quantified with a sagging severity index and associated with a specific location within the mud circulation system. The sagging severity and location predictions may provide a framework for mitigation of mud sagging using automatic control techniques.

20 Claims, 7 Drawing Sheets

(51) Int. Cl.

| | |
|---|---|
| ***E21B 41/00*** | (2006.01) |
| ***E21B 21/00*** | (2006.01) |
| ***E21B 47/10*** | (2012.01) |
| *E21B 21/01* | (2006.01) |
| *E21B 21/06* | (2006.01) |

(52) U.S. Cl.
CPC ..... *E21B 44/00* (2013.01); *E21B 47/10* (2013.01); *E21B 21/01* (2013.01); *E21B 21/062* (2013.01)

(56) References Cited

U.S. PATENT DOCUMENTS

| | | | | |
|---|---|---|---|---|
| 7,128,167 | B2 * | 10/2006 | Dunlop | E21B 44/00 175/24 |
| 8,798,978 | B2 * | 8/2014 | Ertas | E21B 45/00 175/56 |
| 9,222,351 | B2 | 12/2015 | Jamison | |
| 2003/0084717 | A1 | 5/2003 | Herzhaft et al. | |
| 2013/0087385 | A1 * | 4/2013 | Pena | E21B 44/00 175/24 |
| 2013/0292178 | A1 * | 11/2013 | Burress | E21B 44/00 175/50 |
| 2013/0341093 | A1 * | 12/2013 | Jardine | E21B 7/00 175/40 |
| 2014/0172303 | A1 * | 6/2014 | Ibrahim | E21B 47/00 702/6 |
| 2014/0172305 | A1 | 6/2014 | Jamison | |
| 2015/0369030 | A1 | 12/2015 | Hay et al. | |
| 2016/0138395 | A1 | 5/2016 | Kulkarni | |

OTHER PUBLICATIONS

Hugues Thevoux-Chabuel, Integrating real-time drilling information into the geological model, first break, vol. 27, Jul. 2009, pp. 63-67 (Year: 2009).*

Cayeux, E., et al. "Early Symptom Detection on the Basis of Real-Time Evaluation of Downhole Conditions: Principles and Results From Several North Sea Drilling Operations" SPE-150422-PA, vol. 27, issue 4 (2012) available from (Year: 2012).*

Al-yami, A., et al. "Using Bayesian Network to Model Drilling Fluids Practices in Saudi Arabia" SPE-152096-MS, SPE Int'l Production & Operations Conf. (2012) available from (Year: 2012).*

Paslay, P.R., et al. "A Phenomenological Approach to Analysis of Barite Sag in Drilling Muds" SPE-110404-MS, Society of Petroleum Engineers (2007) available from . (Year: 2007).*

Falana, O., et al. "Novel Sag Reducing Additive for Non-aqueous Drilling Fluids" AADE-07-NTCE-03, American Association of Drilling Engineers (2007) (Year: 2007).*

ISR/WO for PCT/US2016/042008 dated Oct. 19, 2016.

* cited by examiner

MUD SAG MONITORING AND CONTROL

BACKGROUND

As the mud is circulated through the drill string and returned through the surrounding annulus, the drill bit may be cooled and the drilled cuttings may be circulated to the surface. Solid particles are often added to the mud to obtain a suspension with specified properties that can facilitate the drilling process. For example, weighting agents, such as barite particles, are added to increase the fluid density so that the mud can provide enough hydrostatic pressure to prevent formation fluid or gas from entering the wellbore and/or causing a well kick. However, in some instances, added solid particles and borehole cuttings may settle out from the mud either at the bottom of the borehole or on the bottom-side of an inclined wellbore. This problem is known as "sag" and may lead to unstable fluid rheological behavior. If solid particles settle downward, the drilling mud becomes density stratified. The created pressure imbalance may further accelerate the separation process and may lead to stuck drilling pipe, loss of circulation, and/or misdirection of the drilling path.

Conventionally, the occurrence of a mud sag is detected by comparing the mud-out weight (i.e., as the mud leaves the wellbore) and the mud-in weight (i.e., as the mud enters the wellbore) measurements. However, the long time-delay between these two measurements significantly affects the method's accuracy and may lead to delay in activating sag mitigation procedures. Furthermore, uncertainties associated with the sensors can also lead to inaccurate predictions (or uncertainties) of the mud's sag tendency.

BRIEF DESCRIPTION OF THE DRAWINGS

The following figures are included to illustrate certain aspects of the embodiments, and should not be viewed as exclusive embodiments. The subject matter disclosed is amenable to considerable modifications, alterations, combinations, and equivalents in form and function, as will occur to those skilled in the art and having the benefit of this disclosure.

Figure 1:
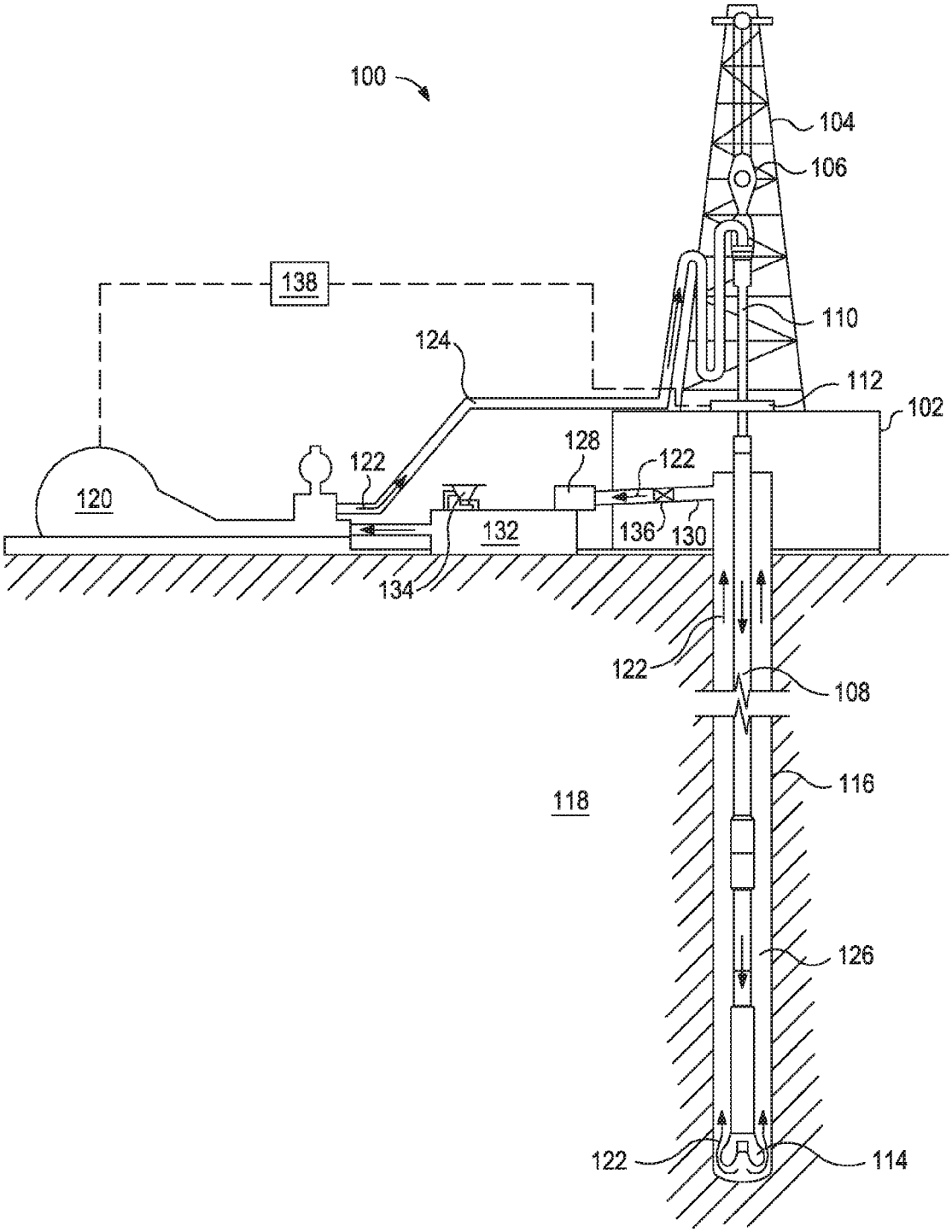
FIG. 1 is an exemplary mud circulation system suitable for implementing the methods described herein.

It should be understood, however, that the specific embodiments given in the drawings and detailed description thereto do not limit the disclosure. On the contrary, they provide the foundation for one of ordinary skill to discern the alternative forms, equivalents, and modifications that may be encompassed together with one or more of the given embodiments in the scope of the appended claims.

DETAILED DESCRIPTION

Disclosed herein are methods and systems for enhancing workflow performance in the oil and gas industry. More specifically, the present application relates to a mud sag monitoring system for real-time evaluation of sag potential of a circulating mud. The monitoring system includes both physics-based sag prediction models and data-driven sag detection classifiers that allow for predicting the sag potential. The sag potential may also be quantified with a sag severity index and associated with a specific location within the mud circulation system. The sag severity and location predictions may provide a framework for mitigation of mud sag using automatic control techniques.

FIG. 1 illustrates an exemplary mud circulation system 100 (e.g., a drilling system) suitable for implementing the methods described herein. While FIG. 1 generally depicts a land-based drilling assembly, those skilled in the art will readily recognize that the principles described herein are equally applicable to subsea drilling operations that employ floating or sea-based platforms and rigs, without departing from the scope of the disclosure.

As illustrated, the drilling assembly 100 may include a drilling platform 102 that supports a derrick 104 having a traveling block 106 for raising and lowering a drill string 108. The drill string 108 may include, but is not limited to, drill pipe and coiled tubing, as generally known to those skilled in the art. A kelly 110 supports the drill string 108 as it is lowered through a rotary table 112. A drill bit 114 is attached to the distal end of the drill string 108 and is driven either by a downhole motor and/or via rotation of the drill string 108 from the well surface. As the bit 114 rotates, it creates a borehole 116 that penetrates various subterranean formations 118.

A pump 120 (e.g., a mud pump) circulates mud 122 through a feed pipe 124 and to the kelly 110, which conveys the mud 122 downhole through the interior of the drill string 108 and through one or more orifices in the drill bit 114. The mud 122 is then circulated back to the surface via an annulus 126 defined between the drill string 108 and the walls of the borehole 116. At the surface, the recirculated or spent mud 122 exits the annulus 126 and may be conveyed through chokes 136 (also referred to as a choke manifold) to one or more mud cleaning unit(s) 128 (e.g., a shaker, a centrifuge, a hydrocyclone, a separator (including magnetic and/or electrical separators), a desilter, a desander, a separator, a filter, a heat exchanger, any fluid reclamation equipment, and the like) via an interconnecting flow line 130. After passing through the mud cleaning unit(s) 128, a "cleaned" mud 122 is deposited into a nearby retention pit 132 (e.g., a mud pit or mud tank). While illustrated as being arranged at the outlet of the wellbore 116 via the annulus 126, those skilled in the art will readily appreciate that the mud cleaning unit(s) 128 may be arranged at any other location in the drilling assembly 100 to facilitate its proper function, without departing from the scope of the scope of the disclosure.

At the retention pit 132 (or before or after), the mud circulation system may include one or more mud treatment units. The mud 122 may be treated to change its composition and properties. For example, weighting agents like barite may be added to the mud 122 to increase its density. In another example, base fluid may be added to the mud 122 to decrease its density. In the illustrated mud circulation system 100, the addition of materials to the mud 122 may be achieved with a mixer 134 communicably coupled to or otherwise in fluid communication with the retention pit 132. The mixer 134 may include, but is not limited to, mixers, mixing hopper, flow lines, and related mixing equipment known to those skilled in the art. In other embodiments, however, the materials may be added to the mud 122 at any other location in the drilling assembly 100. In at least one embodiment, for example, there could be more than one retention pit 132, such as multiple retention pits 132 in series. Moreover, the retention pit 132 may be representative of one or more fluid storage facilities and/or units where the materials may be stored, reconditioned, and/or regulated until added to the mud 122.

The various components of the mud circulation system 100 may further include one or more sensors, gauges, pumps, compressors, and the like used store, monitor, regulate, convey, and/or recondition the exemplary muds 122 (e.g., sensors and gauges to measure the composition and/or pressure of the mud, compressors to change the pressure of the mud, and the like).

While not specifically illustrated herein, the disclosed the disclosed mud circulation system 100 may further include drill collars, mud motors, downhole motors and/or pumps associated with the drill string 108, MWD/LWD tools and related telemetry equipment, sensors or distributed sensors associated with the drill string 108, downhole heat exchangers, valves and corresponding actuation devices, tool seals, packers and other wellbore isolation devices or components, and the like. The mud circulation system 100 may also further include a control system 138 communicably coupled to various components of the mud circulation system 100 (e.g., tools, pump 120, the kelly 112, a downhole motor, sensors, and the like) and be capable of executing the mathematical algorithms, methods, and mud circulation system control described herein.

In the methods and systems described herein, a mud sag monitoring system takes in the current process information to evaluate the sag potential of the circulating mud and to predict the sagging location. The methods described herein may utilize model-based prediction methods and data-based pattern classification methods. Depending on the detected severity of the sagging tendency indicated by each method, an appropriate sagging reduction procedure may be activated to minimize the severity of the sagging problem.

Figure 2:
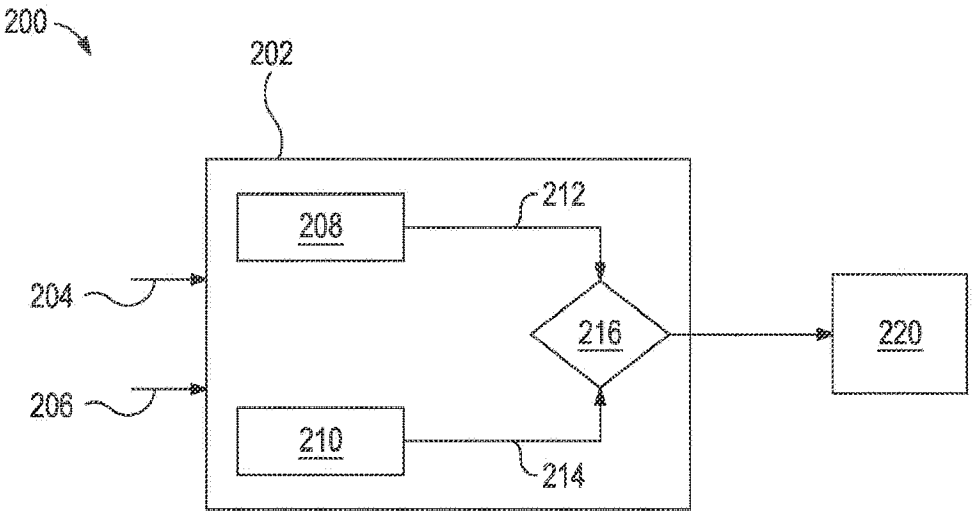
FIG. 2 is a flow diagram of an exemplary scheme of a mud sag detection method.

FIG. 2 shows the structure of an exemplary mud sag monitoring method 200. An expert system 202 evaluates the fluid sagging potential based upon data 204 collected before and during the drilling operation and estimated sensor uncertainties 206 (which is an uncertainty associated with the sagging indices 212,214 later calculated). The expert system 202 outputs if mud sag is likely and, in some instances, to what degree mud sag may be occurring. In the case when the potential is high, a sagging minimizing procedure 220 may be activated that aims to decrease the likelihood of significant fluid sagging.

The data 204 that may be used as inputs into the expert system 202 may include, but is not limited to, (1) the well geometry, especially the wellbore inclination angle, (2) the time trajectories of the drill string inputs, such as the rate of penetration (ROP), weight on bit (WOB), and rotations per minute (RPM), (3) the time trajectories of the mud rheological properties, such as the density, viscosity, and solid profile, and (4) the formation properties. As used herein, the term "time trajectory" refers to future values or value changes over time for a given characteristic, property, or parameter. Time trajectories may be estimated or based on pre-determined values. For example, a pre-determined time trajectory may be based on operating parameters that the viscosity of the mud will change at a given depth for the wellbore. In another example, an estimated time trajectory for the density of the mud may be modeled and take into account the incorporation of drill cutting into the mud.

Within the expert system 202, two possible evaluation methods are used in parallel for evaluating sag potential of the mud. These methods are a pattern-recognition-based evaluation 208 and a model-based evaluation 210. As used herein, the term "pattern-recognition-based evaluation" refers to an evaluation the sagging potential based on the similarity of features and measured behavior of the current mud circulation system and fluid properties to a historical database that collected from past drilling jobs wherein drilling mud sagging was identified as either absent or present. As used herein, the term "model-based evaluation" refers to an evaluation based on a computational model that simulates the drilling process and fluid behavior to simulate current or predict future chance occurrence of sagging.

Each evaluation method 208,210 produces a sagging index 212,214, respectively, quantifying the likelihood of significant fluid sagging. In certain cases, the evaluation method 208,210 may be combined with associated confidence weighting, which is based on the estimated sensor uncertainties 206, to calculate the corresponding sagging index 212,214.

The sagging index 212 determined by the pattern-recognition-based method 208 is based upon the similarity of the data 204 from the current drilling and fluid circulation systems to a historical database formed from past drilling jobs where significant fluid sagging was identified as either absent or present. If fluid sagging is deemed likely to occur, then the pattern-recognition-based method 208 will produce a relatively large value of the sagging index 212. In parallel, model-based evaluation 210 of the possibility of fluid sagging is carried out and reported as a sagging index 214. Finally, the sagging indices 212, 214 obtained from the pattern-recognition-based evaluation 208 and the model-based evaluation 210 and their associated uncertainties 206 are evaluated relative to a threshold at 216. If the either sagging indices 212, 214 exceeds the threshold as determined at 216, the sagging minimizing procedure 220 may be suggested or automatically implemented. These mitigation actions may vary based on the current conditions of the mud circulation system and mud as well as on the predicted severity of sagging.

In some instances, the threshold may be a set value (e.g., if either of the sagging indices 212,214 exceeds 0.8, then the sagging minimizing procedure 220 is implemented). In some instances, the threshold may be a rate of change (e.g., if either of the sagging indices 212,214 exceed changes by greater than 0.5/min, then the sagging minimizing procedure 220 is implemented). In some instances, the threshold may be trajectory dependent.

In general, there are two main types of classification methods that may be used for the pattern-recognition-based method 208: supervised learning and unsupervised learning. In some embodiments, a supervised learning classification method may be chosen for the pattern-recognition-based method 208 to determine the severity of fluid sagging potential based on historical data and current measurement. The classifier created according to the supervised learning classification method may place the current system into one of the possible classes that represent different severe degrees of sagging, from no sagging tendency mud to severe sagging tendency mud. Alternatively, artificial pattern recognizers such as a neural network can be trained as described herein by the historical data and store the information inside the layer connections.

The trained neural network may act as a mathematical function, where the current circulated fluid property measurement and the drilling operation data are the input variables, and the sagging index 212 is the output variable with a value between 0 and 1 (or a comparable variation thereof like 0%-100%). In this nonlimiting example, '0' stands for no sagging tendency and '1' stands for severe sagging tendency.

Figure 3:
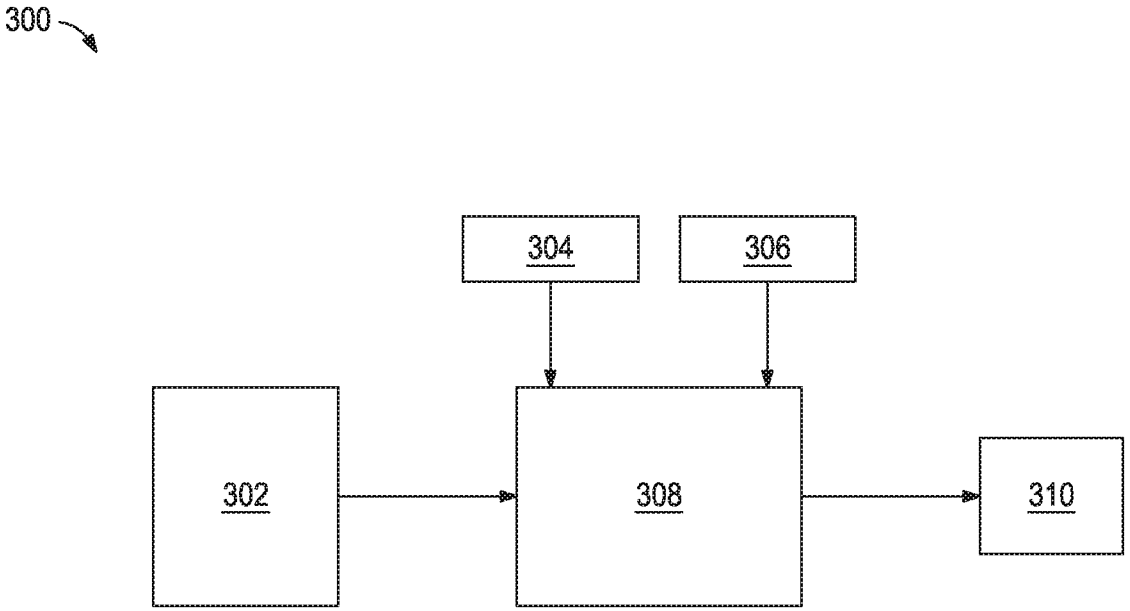
FIG. 3 is a flow diagram of an exemplary scheme of a model-based mud sag detection method.

FIG. 3 is an exemplary flowchart illustrating one possible framework of a model-based evaluation method 300 (e.g., model-based evaluation 210 of FIG. 2). The model-based evaluation method 300 has three inputs: data 302 related to parameters that influence mud sagging and uncertainties (specifically illustrated, sensor uncertainties 304 and estimated uncertainties 306 related to parameters that estimated or modeled not measured by sensors). Some of the primary parameters that influence mud sagging: RPM/WOB/ROP of the drilling operation, the annular velocity of the mud, the wellbore inclination angle, the formation type, the drilling bit type, the bit-formation interface condition, and the mud composition. In some instances, one or more of the foregoing parameters optionally in combination with other parameters may be used as inputs in the model-based evaluation method 300. The parameters used as inputs in the model-based evaluation method 300 may be measured with sensors associated with the mud circulation system or may be modeled or otherwise estimated. Sensor uncertainties 304 associated with measured parameters may be described using a probability model. Estimated uncertainties 306 may be associated with, for example, the mud properties, drill bit condition, and formation parameters.

The data 302, sensor uncertainties 304, and estimated uncertainties 306 are illustrated as inputs to a state and parameter estimator 308 that produces a sagging index 310 (e.g., sagging index 214 of FIG. 2). In this example, the sensor uncertainties 304 and estimated uncertainties 306 are uncertainties associated with the sagging index 310. Generally, the state and parameter estimator 308 compensates for the sensor or parameter uncertainties to provide more accurate measurements.

In one example, the state and parameter estimator 308 may utilize a particle filter. The particle filter incorporates initial state and parameter estimates along with an initial estimate of the probability distribution of these states and parameters. The particle filter then evolves these estimates and their distribution as new data is received. It does this by representing the estimated probability distribution of the unknown states and parameters by a finite number of their possible values, selected from the distribution. The initial estimates of the probability distribution can be obtained, for example, by examining data from past job sites and comparing the initial and final estimates of states and parameters. As used herein, the term "states" relative to the state and parameter estimator 308 refers to a minimum set of system variables that fully describe a dynamic system. The parameters estimated by the particle filter may include, but are not limited to, geomechanical quantities of the formation, parameters describing the prevalence of natural fractures, and fluid properties such as viscosity, among others. As used herein, the term "parameters" relative to the state and parameter estimator 308 refers to any characteristic or an element of a system that contributes to the identity of a system. The states can include estimates of flowrates, concentrations of solids in the fluids, depth of settled drilling solids, and other characteristics describing the severity of sagging, such as density changes, among other quantities.

Figure 4:
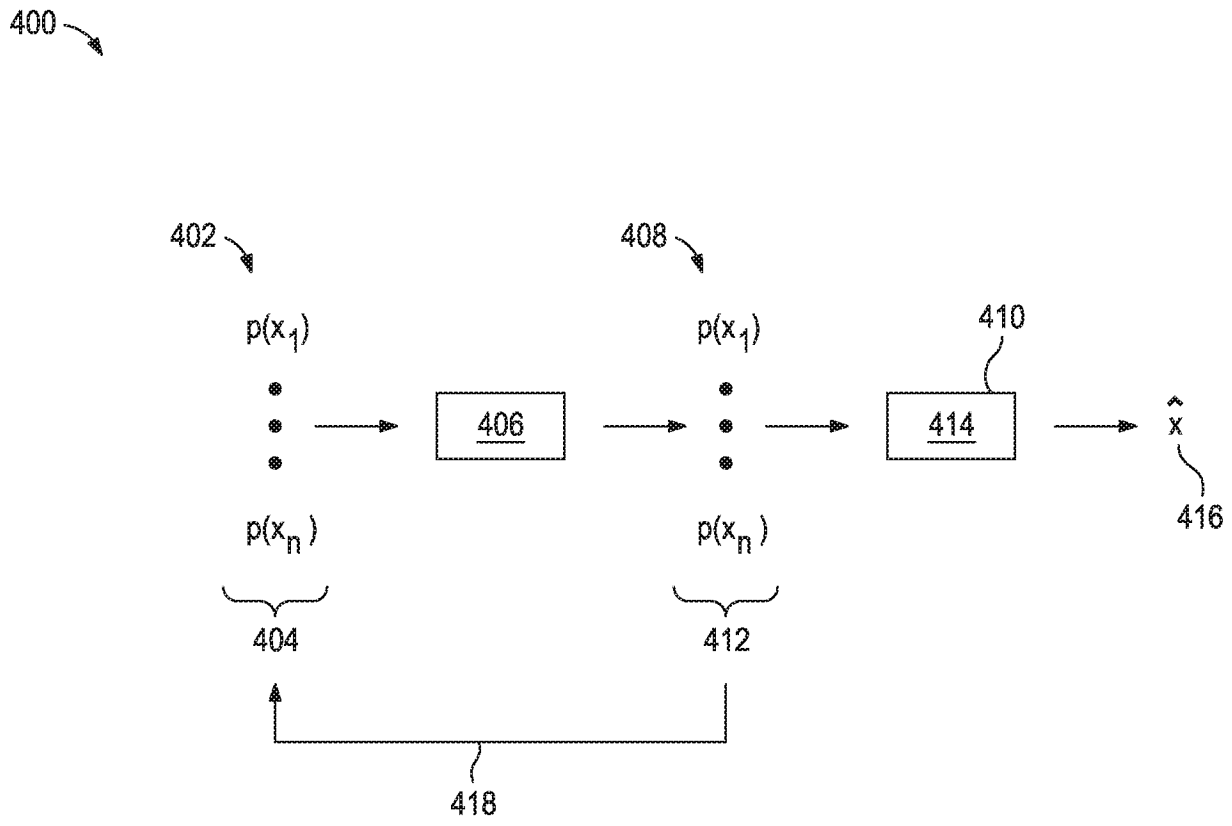
FIG. 4 illustrates particulate filtering for the estimation of the sag state of the mud.

FIG. 4 is a flow diagram illustrating an exemplary particle filter 400. At time step k 402, several different estimates 404 of the current state and parameter vector x are available, with each different estimate of x referred to as a "particle." Each particle has been assigned a relative probability p(x) (i.e., $p(x_1) \ldots p(x_n)$ for n state estimates). The particle filter uses a physical model 406 that includes descriptions of geomechanics, fluid flow, and drilling mechanics to simulate the change in system state until time step k+1 408, thereby producing estimates 412 (i.e., $p(x_1) \ldots p(x_n)$) at time step k+1. At time step k+1 408, a new set of measurements 410 obtained from the actual mud circulation system in real time are available. These measurements 410 are compared (shown at block 414) against the estimates 412 at time step k+1. During this comparison 414, individual particles of the estimates 412 whose associated predictions can accurately predict the measurements are rewarded (given increased relative probability), while those particles which inaccurately predict the new measurements are penalized. The strength of the reward or penalization is dependent upon the relative magnitude of the estimated uncertainties of (1) the state estimates 412 and (2) the measurements 410. After the relative probabilities of each particle are updated, a state estimate $\hat{x}$ 416 can be created and used in the model-based evaluation method (e.g., model-based evaluation 210 of FIG. 2). Meanwhile, the particle filtering algorithm can continue running in an iterative fashion to produce improve sagging state estimates as new measurements become available (shown at loop 418).

Figure 5:
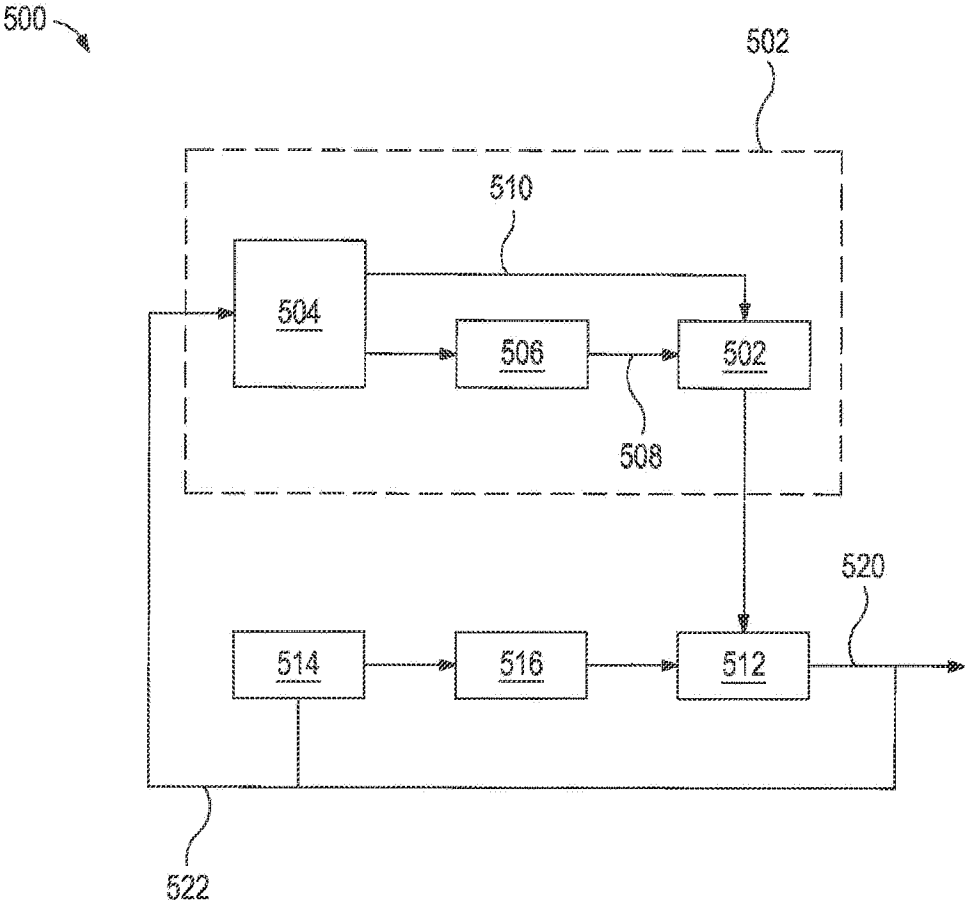
FIG. 5 is a flow diagram of an exemplary scheme of the pattern-based sag detection method.

FIG. 5 illustrates an exemplary structure of the supervised learning classification method 500 for prediction of sagging in a pattern-recognition-based method (e.g., pattern-recognition-based method 208 of FIG. 2). Before classification of the current system is attempted, a classifier training 502 may be created according to the particular supervised learning classification method and based on training data 504, which is historical data collected from past drilling jobs. For data from a past mud circulation profile to be useful as training data 504, the sagging index 510 of this past mud must also be known. The sagging index 510 may be determined based on the past system measurements and/or an expert familiar with the sagging occurrence phenomenon.

The classifier training 502 may reduce the suitable training data 504 using feature extraction 506 to produce a set of features 508, which are the basic unit that the pattern-recognition-based method operates upon. A feature 508 may be any quality that can be used to describe a member of the set being classified, and features may include, but are not limited to, measured quantities (e.g., solids profile, density (or, more specifically, pump-in density and pump-out density), viscosity (or, more specifically, pump-in viscosity and pump-out viscosity), wellbore inclination angle, drilling ROP, drilling RMP, drilling WOB, drilling bit type, bit face condition, annular circulating velocity, and the formation parameters/properties), modeled parameters (e.g., the time trajectories of manipulated variables and system measurements), and/or choices made during an operation. The trajectories of the manipulated variables refer to records of system inputs such as the annulus circulating velocity, the pumping pressure, the additive flow rates and the drilling input variables.

Feature extraction from modeled parameters may involve identification of one or more models to describe the time-dependent manipulated variable, or measurement trajectories. Possible implementations may include fitting polynomial model or time series models between the different available time trajectories and using the model parameters as features. For example, an ARMAX type model describing the relation between the fluid pump-out density $\rho_t$ and the weighting agent addition rate $q_{w_t}$ such as $\rho_t = \gamma_1 q_{w_{t-1}} + \ldots + \gamma_n q_{w_{t-n}} + \delta_{1\rho t-1} + \ldots + \delta_{m\rho t-m} + c\, e_t$ could be used to generate features from the coefficients $\gamma_i$, $\delta_j$, & c. The features 508 and sagging indices 510 may then be used as inputs for designing a classifier 512.

By way of nonlimiting example, the support vector machine (SVM) method is one type of popular classifier 512. The SVM can assign the current operation into one of several predefined classes such as "significant sagging unlikely" or "significant sagging likely." Another exemplary classifier 512 is a neural network classifier. A neural network classifier can be used to provide a 0-1 real-number measure of the likeliness of the occurrence of significant sagging. Other exemplary classifiers 512 may include perceptron algorithm or Bayesian methods. In some instances, a kernel version of the foregoing classifier examples may be used.

Whichever type is chosen, the classifier 512 is trained to give good performance on the set of features 508 extracted from the training data 504. Given the features 508, the classifier 512 may be able to predict whether or not significant sagging occurred in each case of the training set of data. The classifier training 502 may be carried out offline any time before the current drilling job. After the classifier 512 is finalized, it may be used on data 514 in subsequent drilling operations. For example, a sagging index 520 for a present drilling operation may be produced by running the classifier 512 on the set of features 516 provided via a feature extraction 516 (which may be similar to feature extraction 506) from the data 514 of the present drilling operation.

Due to the effect of various drilling operating environments on the classifier 512, a reclassification may be required from field to field, or zone to zone. As data 514 is used for current sagging potential estimation, it may be further integrated into the training (illustrated in loop 522) with known post job performance metrics. If there is a consistent error in the classifier 512, depending on the severity, the classifier 512 may be scraped and relearned with the new system data. When this relearning is in process, the margin boundary becomes the feedback term for the operator to understand the quality of the classifier 512. Once the margin drops below a specified level, which indicated the model distribution has a decreased standard deviation; it can again be used to monitor the fluid circulating system.

As described in FIG. 2, a sagging minimizing procedure 220 may be implemented when either of the sagging indices 212,214 exceeds the threshold. In some instances, the sagging indices 212,214 may be associated with a location along the wellbore. With sagging location prediction, the distributions of the fluid load of the suspended drilling cuttings as well as the solids settled in the wellbore may be estimated. Sagging location prediction may be useful for selection of the proper sagging minimizing procedure 220 when significant sagging is expected to occur. Sagging location prediction may also be useful for determining the probable side effects of should significant sagging occur. For example, sagging around the drill bit could lead to bit-balling, while sagging further up in the wellbore are more likely to lead to other problems such as stuck pipe.

Like the sagging severity prediction, sagging location prediction may rely on both a pattern-recognition-based evaluation and a model-based evaluation. In the pattern-recognition-based evaluation for sagging location prediction, attributes of the current downhole condition may be used to predict where in the wellbore sagging is likely. These attributes could include ROP and occurrence of unexpected drill bit movements, which would help predict sagging near the tip, while other attributes such as wellbore inclination, dogleg severity, and estimated fluid viscosity may be used to predict sagging occurrence in other parts of the wellbore. In the model-based evaluation for sagging location prediction, the wellbore may be divided into a 2- or 3-dimensional grid and in each cell of this grid, the amount of suspended and settled solids are estimated using, for example, a 2- or 3-dimensional CFD (computational fluid model) to describe the fluid flow around the bit and through the annular space.

Furthermore, as sagging location is identified by the CFD model, mesh refinement can be carried out, which increases the number of cells in a given portion of the 2- or 3-dimensional grid, thereby essentially zooming in on a portion of the wellbore of interest. With mesh refinement, a finer mesh is used in areas where sagging is predicted to be more severe and a more coarse mesh in the areas where sagging is not predicted, which may improve the prediction accuracy while decreasing the computational load. The use of a state estimation technique, such as the particle filter, may be implemented in order to deal with the system and measurement uncertainties and provide the most accurate estimate of downhole condition possible. The sagging location prediction may be run regularly as a standard component of the sagging detection module, or alternatively, only in the case that the sagging detection module detects that significant sagging is likely. In the latter case, significant reduction in computational effort may be achieved.

After the classification by each method is available, if the predicted severity is above a predefined threshold, a mitigation strategy may be suggested by a second expert system, in order to provide a set of actions to take that will avoid significant sagging.

Figure 6:
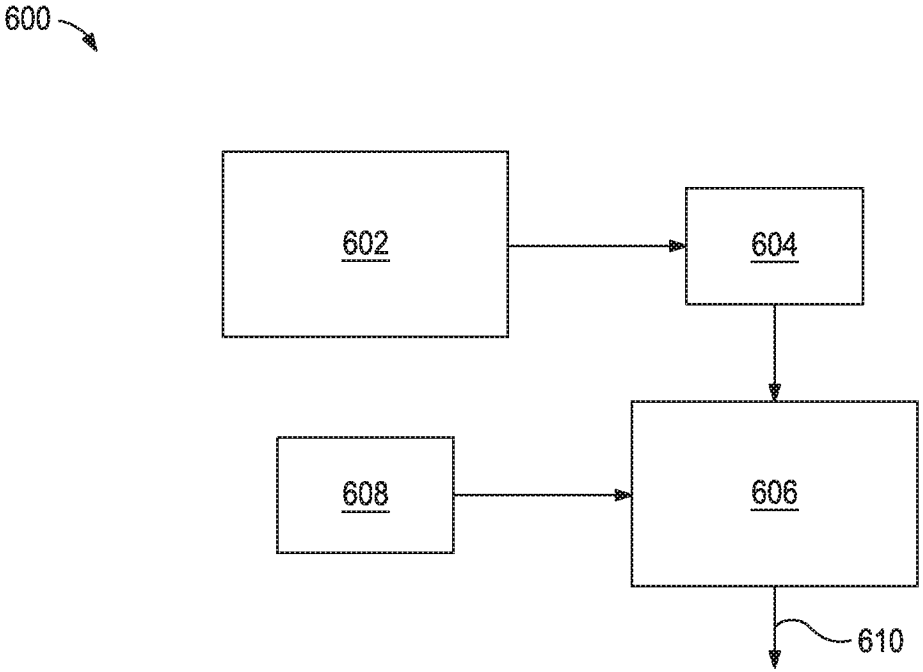
FIG. 6 is a flow diagram of an exemplary mitigation strategy selection.

FIG. 6 illustrates a flow diagram 600 for integrating a second expert system 606 for sagging mitigation strategy selection with an exemplary mud sag monitoring method 604 (e.g., mud sag monitoring method 200 of FIG. 2). The data and uncertainties 602 may be used by the mud sag monitoring method 604 (which uses a first expert system as described in FIG. 2) determine if sagging is likely.

Any of the manipulated variables available to the second expert system 606 for sagging mitigation strategy selection, as well as, any factors (operational parameters) changeable by operators may be considered in the mitigation strategy selection. For the control actions on the muds mixing or mud circulation systems, the mitigation strategies may be computed by a PID (proportional-integral-derivative) control algorithm or a model-based method such as MPC (model predictive control) or a combination of both types of controllers. For model-based method, the first step taken by the second expert system 606 may be to use a model to predict the effect of changing each possible factor on the amount of sagging. Then, based upon the required predicted sagging severity and the required speed of response 608, the expert system 606 for sagging mitigation strategy selection may determine the appropriate operational parameter to adjust based on the following criteria: (1) sensitivity of the sagging index to changes in the operational parameter, (2) response speed of the sagging index to changes in the operational parameter, (3) probability that significant sagging is avoided by changes in the operational parameter, and (4) effect of changes in the operational parameter on the overall drilling operation. After the mitigation strategy(s) 610 is(are) selected, the mitigation strategy(s) 610 may be either reported to operators or else carried out automatically upon the automatic control system. In some instances, the mitigation strategy(s) 610 may be an optimal mitigation strategy. In some instances, the mitigation strategy(s) 610 may be two or more mitigation strategies that an operator may choose from based on cost, equipment availability, and implementation or down time.

Figure 7:
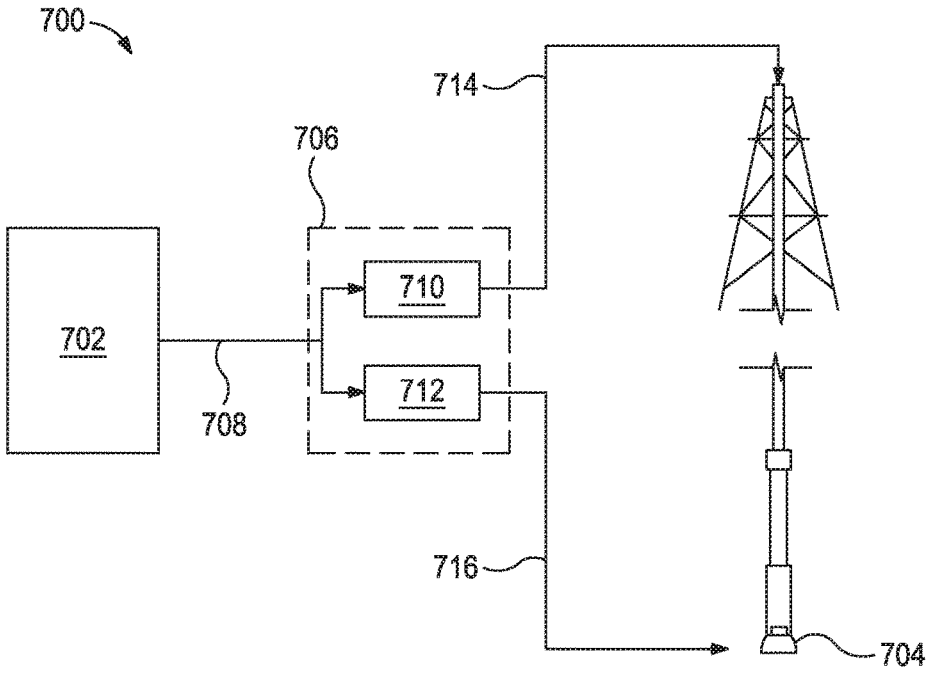
FIG. 7 is a flow diagram of an exemplary feedforward control strategy for sag mitigation.
Figure 7:
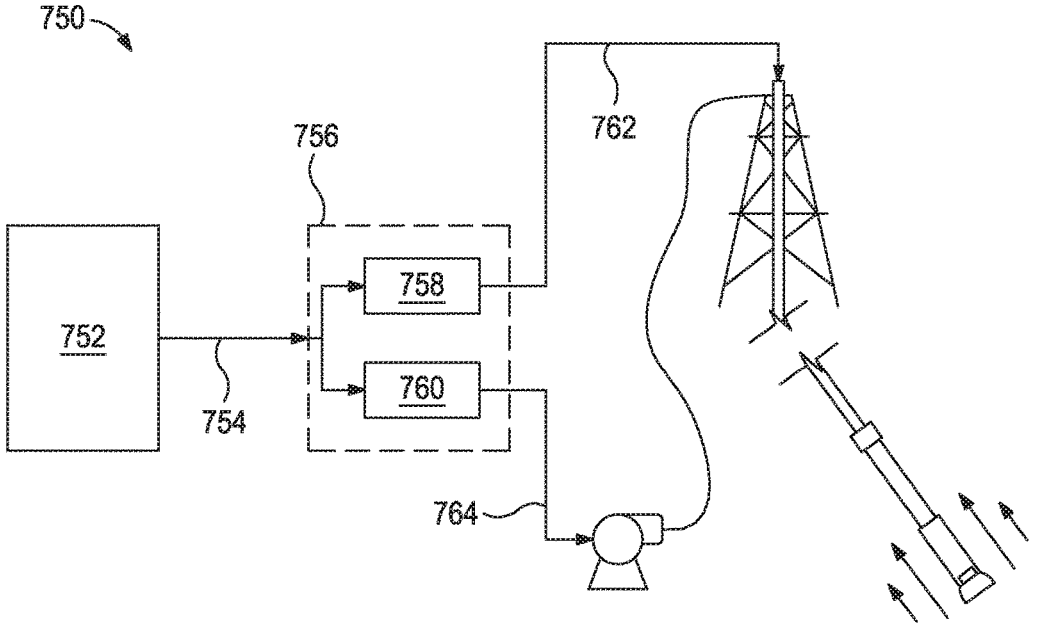

FIG. 7 illustrates two possible system-wide scenarios 700,750 where a mud sag monitoring method 702 (e.g., mud sag monitoring method 200 of FIG. 2) is employed and predicts fluid sag in two different locations. In Scenario 1 700, the sagging detection module 702 detects that significant sagging will occur in the area around the drill bit 704. A feedforward control module 706 accepts the predicted sagging severity 708 and uses two PID controllers 710,712 to drive the weight-on-bit lower 714 while simultaneously increasing the drill bit rotation speed 716. This combination of control actions will result in decreased ROP, which will further result in a lower rate of drill cuttings creation. By maintaining mud flow and this decreased ROP, the hole cleansing in the area around the bit will increase. The downhole solids concentration will decrease, mitigating the presence of sagging.

In Scenario 2 750, the sagging detection module 752 detects significant sagging will occur around the drill string. If the drill string were to stop rotating in such a situation, stuck pipe could potentially occur. In this case, the feedforward control module 756 implements two PID controllers 758,760, which intake the predicted sagging severity 754. In response to the predicted sagging severity 754, the two PID controllers 758,760 increase the drill pipe rotation speed 762 and increase the pumping speed 764. The increased pumping speed 764 provides increased mud circulation velocity, while the increased drill string rotation speed 762 provides a higher annular Reynolds number. This increase in fluid turbulence can increase the rate that solids are carried away from the downhole, mitigating the sagging severity.

The foregoing examples demonstrate sagging mitigation strategies using PID control. However, other control techniques such as model-based control can be employed and other sets of mud circulation system parameters can be manipulated in order to mitigate sagging.

Numerous other variations and modifications will become apparent to those skilled in the art once the above disclosure is fully appreciated. It is intended that the following claims be interpreted to embrace all such variations, modifications and equivalents. In addition, the term "or" should be interpreted in an inclusive sense.

The mud sag monitoring methods and sagging mitigation strategy selections described herein may be performed using one or more control systems. The control system(s) described herein and corresponding computer hardware used to implement the various illustrative blocks, modules, elements, components, methods, and algorithms described herein can include a processor configured to execute one or more sequences of instructions, programming stances, or code stored on a non-transitory, computer-readable medium. The processor can be, for example, a general purpose microprocessor, a microcontroller, a digital signal processor, an application specific integrated circuit, a field programmable gate array, a programmable logic device, a controller, a state machine, a gated logic, discrete hardware components, an artificial neural network, or any like suitable entity that can perform calculations or other manipulations of data. In some embodiments, computer hardware can further include elements such as, for example, a memory (e.g., random access memory (RAM), flash memory, read only memory (ROM), programmable read only memory (PROM), erasable programmable read only memory (EPROM)), registers, hard disks, removable disks, CD-ROMS, DVDs, or any other like suitable storage device or medium.

Executable sequences described herein can be implemented with one or more sequences of code contained in a memory. In some embodiments, such code can be read into the memory from another machine-readable medium. Execution of the sequences of instructions contained in the memory can cause a processor to perform the process steps described herein. One or more processors in a multi-processing arrangement can also be employed to execute instruction sequences in the memory. In addition, hard-wired circuitry can be used in place of or in combination with software instructions to implement various embodiments described herein. Thus, the present embodiments are not limited to any specific combination of hardware and/or software.

As used herein, a machine-readable medium will refer to any medium that directly or indirectly provides instructions to a processor for execution. A machine-readable medium can take on many forms including, for example, non-volatile media, volatile media, and transmission media. Non-volatile media can include, for example, optical and magnetic disks. Volatile media can include, for example, dynamic memory. Transmission media can include, for example, coaxial cables, wire, fiber optics, and wires that form a bus. Common forms of machine-readable media can include, for example, floppy disks, flexible disks, hard disks, magnetic tapes, other like magnetic media, CD-ROMs, DVDs, other like optical media, punch cards, paper tapes and like physical media with patterned holes, RAM, ROM, PROM, EPROM and flash EPROM.

Some embodiments of the present disclosure include a method comprising: drilling a wellbore penetrating a subterranean formation with a drilling mud according to a set of drilling parameters; measuring at least one drilling condition while drilling; calculating one or more sagging indices to detect the occurrence of drilling mud sag at one or more locations along the wellbore with a dynamic model of cuttings transportation, wherein the dynamic model is based on a fundamental understanding of fluid flow and solids transport, a data-driven identification method, or a combination of both; and adjusting operational parameters of the mud circulation system when at least one of the sagging indices is greater than a threshold value. Such methods may further include at least one of: (1) wherein the at least one drilling condition includes: mud density, mud viscosity, weighting agent concentration in the drilling mud, or a combination thereof; (2) wherein the set of drilling parameters includes: rate of penetration, weight on bit, bit rotations per minute, well geometry; (3) wherein the data-driven identification method for calculating the one or more sagging indices uses a pattern-recognition-based evaluation that compares the set of drilling parameters and the at least one drilling condition to historical data; (4) wherein the pattern-recognition-based evaluation involves identifying features or attributes from (1) a historical data set or (2) a description from one or more past drilling operations; (5) wherein the pattern-recognition-evaluation involves producing a classifier to determine a presence and/or a severity of sagging; (6) wherein the classifier is generated by one or more pattern-recognition algorithms including: support-vector machine algorithm, perceptron algorithm, Bayesian methods, or kernel versions thereof; or (7) wherein identifying the features or the attributes produces an identified feature or attribute set, the method further including transforming the identified feature or attribute set using one of the standard feature-reduction techniques including: a principle component analysis, a singular value decomposition, or another method that transform a beginning set of features or attributes to a smaller number of transformed features or attributes before further pattern-recognition-based evaluation.

Some embodiments of the present disclosure include a method comprising: drilling a wellbore penetrating a subterranean formation with a drilling mud according to a set of drilling parameters; estimating the drilling parameters needed for describing a severity of sagging with a mud circulation system state estimation framework that includes a probability model; measuring the drilling parameters needed for describing the severity of sagging; adapting the probability model with a particle filter; and identifying uncertainties associated with the measured drilling parameters.

Some embodiments of the present disclosure include a method comprising: drilling a wellbore penetrating a subterranean formation with a drilling mud according to a set of drilling parameters; measuring at least one drilling condition while drilling; identifying one or more first locations along the wellbore where mud sagging is most likely using a pattern-recognition-based evaluation that compares the set of drilling parameters and the at least one drilling condition to historical data; identifying one or more second locations along the wellbore where mud sagging is most likely using a model-based evaluation based on a 2- and/or 3-dimensional computational fluid model that estimates an amount of suspended and settled solids; and when a first location and a second location are the same, performing a remedial operation to mitigate sag thereat. Such methods may further include at least one of: (1) wherein the first and second location are at or near a drill bit drilling the wellbore, and wherein the remedial operation involves decreasing a weight-on-bit and simultaneously increasing a drill bit rotational speed; or wherein the first and second location are a drill string extending into the wellbore, and wherein the remedial operation involves increasing a drill string rotational speed and a mud pumping speed.

Some embodiments of the present disclosure include system comprising: a mud circulation system having a drilling mud circulating therethrough and having a plurality of sensors along the mud circulation system that measure drilling parameters; an expert system comprising a set of mitigation actions in order to avoid the occurrence of significant sagging; and a designed controller embedded inside the expert system configured to make decisions regarding adjustments to the drilling parameters in order to avoid or reduce sagging in the mud circulation system. Such systems may further include: wherein the designed controller uses a computational model of the mud circulation system and an optimization algorithm to calculate a sequence of drilling parameter adjustments that minimizes sagging indices.

Embodiments described herein include, but are not limited to, Embodiment A, Embodiment B, and Embodiment C.

Embodiment A is a method that comprises: drilling a wellbore penetrating a subterranean formation with a drilling mud according to a set of drilling parameters; measuring a drilling condition with a sensor while drilling, thereby producing data; calculating a first sagging index using a pattern-recognition-based evaluation of the data and an associated uncertainty of the first sagging index; calculating a second sagging index using a model-based evaluation of the data and an associated uncertainty of the second sagging index; and adjusting at least one of the drilling parameters of the mud circulation system to mitigate sag when the first sagging index, the second sagging index, or both are greater than a threshold value.

Embodiment B is a system that comprises: a drill string within a wellbore penetrating a subterranean formation; a pump configured to convey drilling mud through the drill string and the wellbore; a sensor coupled to the system to measure a drilling condition; a non-transitory computer-readable medium coupled to the drill string, the pump, or both and encoded with instructions that, when executed, cause the system to perform a method comprising: measuring a drilling condition with the sensor while drilling the wellbore with a drilling mud according to a set of drilling parameters, thereby producing data; calculating a first sagging index using a pattern-recognition-based evaluation of the data and an associated uncertainty of the first sagging index; calculating a second sagging index using a model-based evaluation of the data and an associated uncertainty of the second sagging index; and adjusting at least one of the drilling parameters of the mud circulation system to mitigate sag when the first sagging index, the second sagging index, or both are greater than a threshold value.

Embodiment C is a non-transitory computer-readable medium encoded with instructions when executed, cause a mud circulation system to perform a method comprising: measuring a drilling condition with a sensor while drilling a wellbore with a drilling mud according to a set of drilling parameters, thereby producing data; calculating a first sagging index using a pattern-recognition-based evaluation of the data and an associated uncertainty of the first sagging index; calculating a second sagging index using a model-based evaluation of the data and an associated uncertainty of the second sagging index; and adjusting at least one of the drilling parameters of the mud circulation system to mitigate sag when the first sagging index, the second sagging index, or both are greater than a threshold value.

Embodiments A, B, and C may optionally further include one or more of the following: Element 1: wherein the set of drilling parameters comprises at least one selected from the group consisting of: rate of penetration of a drill bit, weight on the drill bit, rotations per minute of the drill bit, density of the drilling mud, viscosity of the drilling mud, annular circulating velocity, a drill bit type, and any combination thereof; Element 2: wherein the drilling condition comprises at least one selected from the group consisting of: a solids profile of the drilling mud, a pump-in density of the drilling mud, a pump-out density of the drilling mud, a pump-in viscosity of the drilling mud, a pump-out viscosity of the drilling mud, rate of penetration of a drill bit, weight on the drill bit, rotations per minute of the drill bit, drill bit face condition, annular circulating velocity, and any combination thereof; Element 3: wherein the pattern-recognition-based evaluation compares the set of drilling parameters to historical data; Element 4: Element 3 and wherein the pattern-recognition-evaluation involves producing a classifier to determine a presence of sagging; Element 5: Element 3 and wherein the pattern-recognition-evaluation involves producing a classifier to determine a severity of sagging; Element 6: Element 4 and/or 5 and wherein the classifier is generated by one or more pattern-recognition algorithms selected from the group consisting of: support-vector machine algorithm, perceptron algorithm, Bayesian methods, neural network methods, and kernel versions thereof; Element 7: wherein the model-based evaluation uses a particle filter; Element 8: wherein the data, the first sagging index, and the second sagging index are associated with a location along the wellbore; Element 9: wherein the threshold is selected from the group consisting of: an absolute threshold, a rate-of-change threshold, and a time trajectory threshold; and Element 10: the method further comprising: determining the at least one of the drilling parameters to be changed to mitigate sag using a sagging mitigation strategy selection based on: (1) sensitivity of the first and/or second sagging index to the at least one of the drilling parameters, (2) response speed of the first and/or second sagging index to the at least one of the drilling parameters, (3) probability that significant sagging is avoided by a change in the at least one of the drilling parameters, and (4) effect of the at least one of the drilling parameters in the operational parameter on the overall drilling operation. Exemplary combinations may include, but are not limited to, Element 1 in combination with Element 2 and optionally further combination with Element 3; Elements 1 or 2 in combination with Element 3; one or more of Elements 1-3 in combination with one or more of Elements 4-6 and optionally in further combination with one or more of Elements 7-10; one or more of Elements 1-3 in combination with one or more of Elements 7-10; Element 3 and one or more of Elements 4-6 in combination with one or more of Elements 7-10; and two or more of Elements 7-10 in combination.

Numerous other variations and modifications will become apparent to those skilled in the art once the above disclosure is fully appreciated. It is intended that the following claims be interpreted to embrace all such variations, modifications and equivalents. In addition, the term "or" should be interpreted in an inclusive sense.

Unless otherwise indicated, all numbers expressing quantities of ingredients, properties such as molecular weight, reaction conditions, and so forth used in the present specification and associated claims are to be understood as being modified in all instances by the term "about." Accordingly, unless indicated to the contrary, the numerical parameters set forth in the following specification and attached claims are approximations that may vary depending upon the desired properties sought to be obtained by the embodiments of the present invention. At the very least, and not as an attempt to limit the application of the doctrine of equivalents to the scope of the claim, each numerical parameter should at least be construed in light of the number of reported significant digits and by applying ordinary rounding techniques.

One or more illustrative embodiments incorporating the invention embodiments disclosed herein are presented herein. Not all features of a physical implementation are described or shown in this application for the sake of clarity. It is understood that in the development of a physical embodiment incorporating the embodiments of the present invention, numerous implementation-specific decisions must be made to achieve the developer's goals, such as compliance with system-related, business-related, government-related and other constraints, which vary by implementation and from time to time. While a developer's efforts might be time-consuming, such efforts would be, nevertheless, a routine undertaking for those of ordinary skill the art and having benefit of this disclosure.

While compositions and methods are described herein in terms of "comprising" various components or steps, the compositions and methods can also "consist essentially of" or "consist of" the various components and steps.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present invention. The invention illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces.

The following is claimed:

1. A method comprising:

drilling a wellbore penetrating a subterranean formation with a drilling mud according to a set of drilling parameters;

measuring a drilling condition with a sensor while drilling, thereby producing sensor data;

calculating a first sagging index using a pattern-recognition-based evaluation of the sensor data;

calculating a second sagging index using a model-based evaluation of the sensor data;

evaluating the first sagging index relative to a threshold value;

evaluating the second sagging index relative to the threshold value;

determining at least one of the drilling parameters to be changed to mitigate sag using a sagging mitigation strategy selection based on sensitivity of the first and/or second sagging index to the at least one of the drilling parameters; and adjusting the at least one of the drilling parameters when the first sagging index and the second sagging index are greater than the threshold value.

2. The method of claim 1, wherein the set of drilling parameters comprises at least one selected from the group consisting of: rate of penetration of a drill bit, weight on the drill bit, rotations per minute of the drill bit, density of the drilling mud, viscosity of the drilling mud, annular circulating velocity, a drill bit type, and any combination thereof.

3. The method of claim 1, wherein the drilling condition comprises at least one selected from the group consisting of: a solids profile of the drilling mud, a pump-in density of the drilling mud, a pump-out density of the drilling mud, a pump-in viscosity of the drilling mud, a pump-out viscosity of the drilling mud, rate of penetration of a drill bit, weight on the drill bit, rotations per minute of the drill bit, drill bit face condition, annular circulating velocity, and any combination thereof.

4. The method of claim 1, wherein the pattern-recognition-based evaluation compares the set of drilling parameters to historical data.

5. The method of claim 4, wherein the pattern-recognition-evaluation involves producing a classifier to determine a presence and/or a severity of sagging.

6. The method of claim 5, wherein the classifier is generated by one or more pattern-recognition algorithms selected from the group consisting of: support-vector machine algorithm, perceptron algorithm, Bayesian methods, neural network methods, and kernel versions thereof.

7. The method of claim 1, wherein the model-based evaluation uses a particle filter.

8. The method of claim 1, wherein the data, the first sagging index, and the second sagging index are associated with a location along the wellbore.

9. The method of claim 1, wherein the threshold is selected from the group consisting of: an absolute threshold, a rate-of-change threshold, and a time trajectory threshold.

10. The method of claim 1, wherein said determining the at least one of the drilling parameters to be changed includes determining the at least one of the drilling parameters based on: response speed of the first and/or second sagging index to the at least one of the drilling parameters; probability that significant sagging is avoided by a change in the at least one of the drilling parameters; and effect of the at least one of the drilling parameters in the operational parameter on the overall drilling operation.

11. A mud circulation system comprising:

a drill string within a wellbore penetrating a subterranean formation;

a pump configured to convey a drilling mud through the drill string and the wellbore;

a sensor coupled to the system to measure a drilling condition;

a non-transitory computer-readable medium coupled to the drill string, the pump, or both and encoded with instructions that, when executed, cause the system to perform a method comprising:

measuring a drilling condition with the sensor while drilling the wellbore with the drilling mud according to a set of drilling parameters, thereby producing sensor data;

calculating a first sagging index using a pattern-recognition-based evaluation of the sensor data;

calculating a second sagging index using a model-based evaluation of the data;

determining at least one of the drilling parameters to be changed to mitigate sag using a sagging mitigation strategy selection based on sensitivity of the first and/or second sagging index to the at least one of the drilling parameters; and adjusting the at least one of the drilling parameters when the first sagging index and the second sagging index are greater than a threshold value.

12. The system of claim 11, wherein the pattern-recognition-based evaluation compares the set of drilling parameters to historical data.

13. The system of claim 12, wherein the pattern-recognition-evaluation involves producing a classifier to determine a presence and/or a severity of sagging.

14. The system of claim 13, wherein the classifier is generated by one or more pattern-recognition algorithms selected from the group consisting of: support-vector machine algorithm, perceptron algorithm, Bayesian methods, neural network methods, and kernel versions thereof.

15. The system of claim 11, wherein the model-based evaluation uses a particle filter.

16. The system of claim 11, wherein the data, the first sagging index, and the second sagging index are associated with a location along the wellbore.

17. The system of claim 11, wherein the threshold is selected from the group consisting of: an absolute threshold, a rate-of-change threshold, and a time trajectory threshold.

18. The system of claim 11, wherein said determining the at least one of the drilling parameters to be changed includes determining the at least one of the drilling parameters based on: response speed of the first and/or second sagging index to the at least one of the drilling parameters; probability that significant sagging is avoided by a change in the at least one of the drilling parameters; and effect of the at least one of the drilling parameters in the operational parameter on the overall drilling operation.

19. A non-transitory computer-readable medium encoded with instructions that, when executed, cause a mud circulation system to perform a method comprising:

measuring a drilling condition with a sensor while drilling a wellbore with a drilling mud according to a set of drilling parameters, thereby producing sensor data;

calculating a first sagging index using a pattern-recognition-based evaluation of the sensor data;

calculating a second sagging index using a model-based evaluation of the sensor data;

determining at least one of the drilling parameters to be changed to mitigate sag using a sagging mitigation strategy selection based on sensitivity of the first and/or second sagging index to the at least one of the drilling parameters; and adjusting the at least one of the drilling parameters when the first sagging index and the second sagging index are greater than a threshold value.

20. The non-transitory computer-readable medium of claim 19, wherein said determining the at least one of the drilling parameters to be changed includes determining the at least one of the drilling parameters based on: response speed of the first and/or second sagging index to the at least one of the drilling parameters; probability that significant sagging is avoided by a change in the at least one of the drilling parameters; and effect of the at least one of the drilling parameters in the operational parameter on the overall drilling operation.

* * * * *